United States Patent [19]

Landa et al.

[11] 4,411,976

[45] Oct. 25, 1983

[54] METHOD OF INCREASING THE DENSITY OF LIQUID-DEVELOPED GAP-TRANSFERRED ELECTROPHOTOGRAPHIC IMAGES AND DEVELOPING COMPOSITION FOR USE THEREIN

[75] Inventors: Benzion Landa, Edmonton, Canada; E. Paul Charlap, Larchmont, N.Y.

[73] Assignee: Savin Corporation, Valhalla, N.Y.

[21] Appl. No.: 338,519

[22] Filed: Jan. 11, 1982

Related U.S. Application Data

[63] Continuation-in-part of Ser. No. 338,006, Jan. 8, 1982.

[51] Int. Cl.[3] ..... G03G 9/12

[52] U.S. Cl. ..... 430/114; 430/115; 430/119; 430/126

[58] Field of Search ..... 430/118, 119, 137, 114, 430/115, 126

[56] References Cited

U.S. PATENT DOCUMENTS

| | | | |
|---|---|---|---|
| 2,899,335 | 8/1959 | Straughan | 430/119 |
| 3,795,530 | 3/1974 | Gundlach | 430/112 |
| 3,997,488 | 12/1976 | Tsubuko et al. | 430/137 |
| 4,052,325 | 10/1977 | Santilli | 430/119 |
| 4,104,183 | 8/1978 | Tsuboko et al. | 430/119 |
| 4,325,627 | 4/1982 | Swidler et al. | 430/119 |

FOREIGN PATENT DOCUMENTS

| | | | |
|---|---|---|---|
| 682502 | 3/1964 | Canada | 430/112 |

*Primary Examiner*—John E. Kittle
*Assistant Examiner*—John L. Goodrow
*Attorney, Agent, or Firm*—Shenier & O'Connor

[57] ABSTRACT

The invention comprises a method of transferring a liquid-developed electrostatic image across a gap to a carrier sheet accompanied by heating of the carrier sheet, either before or after transfer, to a temperature at which the binder or polymer forming the toner particles will solvate in the liquid entrained in the transferred image to increase the density of the image. Thus temperature is above ambient temperature but below 100° C. The composition comprises an insulating dispersant liquid through which is disseminated a pigmented waxy binder or polymer which is insoluble in the dispersant liquid at room temperature but will solvate in the dispersant liquid at elevated temperatures.

5 Claims, 3 Drawing Figures

METHOD OF INCREASING THE DENSITY OF LIQUID-DEVELOPED GAP-TRANSFERRED ELECTROPHOTOGRAPHIC IMAGES AND DEVELOPING COMPOSITION FOR USE THEREIN

CROSS REFERENCE TO RELATED APPLICATIONS

This application is a continuation-in-part of our copending application, Ser. No. 338,006, filed Jan. 8, 1982.

The present application is related to application Ser No. 149,539, filed May 13, 1980, for "Improved Process and Apparatus for Transferring Developed Electrostatic Images to a Carrier Sheet, Improved Carrier Sheet for Use in the Process and Method of Making the Same", now U.S. Pat. No. 4,364,661; to our application Ser. No. 249,336, filed Mar. 31, 1981, for "Improved Method and Apparatus for Transferring Electrostatic Images to a Carrier Sheet", now U.S. Pat. No 4,378,422; to application Ser. No. 250,720, filed Apr. 3, 1981, for "Composition for Developing Latent Electrostatic Images for Gap Transfer", to application Ser. No. 267,465, filed May 27, 1981, for "Improved Method and Apparatus for Developing Latent Electrostatic Images for Gap Transfer and Improved Composition for Use Therewith", and to application Ser. No. 298,351, filed Sept. 1, 1981, for "Developing Composition for a Latent Electrostatic Image for Transfer of the Developed Image Across a Gap to a Carrier Sheet". The present invention is an improved method which produces an increase of density of liquid-developed gap-transferred electrophotographic images and an improved developing composition for use therein.

BACKGROUND OF THE INVENTION

In the above-identified copending applications, the latent electrostatic image, formed in a manner known to the art, is developed by a liquid developing composition. The liquid developer usually comprises a dielectric liquid, such as a low-boiling aliphatic hydrocarbon, in which are dispersed pigmented particles. These particles are conventionally formed of carbon black associated with a polymer. These pigmented particles are referred to as "toner particles". They are normally charged to a polarity opposite to the charge of the latent image, so that they will move to the image by electrophoresis to develop the same. In the copending applications, above identified, there have been disclosed various methods and forms of apparatus for forming a gap between the carrier sheet and the developed electrophotographic image, across which gap the image is to be transferred. There has been pointed out that, in the prior art, part of the carrier liquid in the non-image areas will be absorbed by the carrier sheet and must be dried, usually by heat. This evaporates hydrocarbons into the circumambient atmosphere. The amount of evaporation permitted is strictly controlled by law. This limits the speed at which the electrophotographic copying machine can be operated. A non-toxic, light, paraffinic hydrocarbon carrier liquid, such as ISOPAR-G (trademark of Exxon Corporation), is one of the aliphatic hydrocarbon liquids which is used in the developing composition. The contacting of a carrier sheet with the freshly developed image may induce smudging, smearing, or squashing of the developed image. This reduces the resolution. Then too, the charge of the toner particles is opposite to the charge of the latent electrostatic image. This arrangement is such, in the prior art, that the paper tends to stick to the photoconductive, or insulating, surface on which the image is developed. This produces difficulty in removing the carrier sheet bearing the developed image from the photoconductive surface. The usual carrier sheet is paper, and repetitive contact of paper with a moist developed image leaves paper fibers on the photoconductive surface. Since all of the developed image is rarely transferred to the carrier sheet, the paper fibers left behind contaminate the developing liquid.

We have found, as pointed out in the copending applications, above identified, that these disadvantages can be avoided by spacing the carrier sheet from the photoconductor to form a gap and causing the freshly developed image to negotiate the gap between the photoconductor and the carrier sheet by placing a charge on the back of the carrier sheet by means of a corona or the like.

In copending application Ser. No. 149,539, now U.S. Pat. No. 4,364,661, there is described the method of transferring freshly liquid-developed images across a gap. Methods are disclosed of forming a gap by providing the carrier sheet with protuberances formed on the carrier sheet which prevent the contact of the major area of the carrier sheet with the freshly developed image by deforming the sheet or otherwise forming protuberances thereon. In our copending application Ser. No. 249,336, now U.S. Pat. No. 4,378,422, there is disclosed another means of carrying out a gap transfer method. We there provide spacing particles to form the desired gap between the substrate bearing the freshly developed electrostatic image by positioning them on the developed image or by forming spacing protuberances on the photoconductive, or insulating, surface on which the latent electrostatic image is formed.

The developed image, in its transfer across the gap, passes in small geyser-like columns. This is occasioned by the imposition of a field behind the carrier sheet of a polarity opposite to the polarity of the toner particles and of a higher potential than the charge of the latent image. The columns of the developed image, in striking the carrier sheet, form dots. The spacing of these dots varies with the density of the image. This accounts for the gray scale which is achieved by our gap-transfer process. Unfortunately, when copying on rough paper, the dots, while sufficiently dense—that is, thick—will not fill the valleys between the peaks present in a rough-surfaced paper. The result is that a comparatively poor copy appears on a carrier sheet having a rough surface.

FIELD OF THE INVENTION

Our invention relates to an improved method of increasing the density of a liquid-developed image, formed by electrophotography and transferred across a gap to a carrier sheet, irrespective of the surface texture of the carrier sheet, and to a developing liquid for use in practicing our method.

DESCRIPTION OF THE PRIOR ART

Maki et al U.S. Pat. No. 3,993,483, granted Nov. 23, 1976, discloses a developing composition comprising a rosin modified pentaerythritol resin, or the like, together with a low molecular weight polyethylene wax, or the like, disseminated throughout an insulating liquid, such as an aliphatic hydrocarbon, an aromatic hydrocarbon, cyclohexane, naphtha, kerosene, or ISO- PAR-G (trademark of Exxon Corporation). The composition contains charge directors to give the resins a positive or negative charge. The polyethylene wax in this composition is present by weight from about 60 percent of the insoluble resin to four times the amount of insoluble resin by weight. In the instant invention, the developing composition is especially adapted for use in images which are being gap-transferred. The resins of the present invention, which form binders for the pigment, while substantially insoluble in the carrier liquid at room temperature, are solvatable in the carrier liquid at elevated temperatures, such as 100° C. or lower. By "solvation" we mean the formation of complexes or molecular compounds by the combination of molecules of the binder with molecules of the dispersant liquid. These compounds are termed "solvates". The process manifests itself by the swelling, gelling, or dissolution of the binder in the dispersant liquid.

Ariyama et al U.S. Pat. No. 4,059,394, granted Nov. 22, 1977, discloses a heater for "fixing" a carrier sheet to which a wet developed image has been transferred by contact between the developed image on the photoconductor and a paper carrier sheet. The heater "fixes" the image on the carrier sheet. In the instant invention, owing to the fact that in a non-contacting transfer of the developed image on the photoconductor and the carrier sheet the image is transferred in a series of small geysers, or dots, we must use a special toner. The dots present an image which has a grayish, or photogravure-like, look. The heater, in our invention, raises the temperature so that solvation occurs and the dots formed of the resins of our toner will spread to form an image of outstanding density.

Tsubuko et al U.S. Pat. No. 4,060,493, granted Nov. 29, 1977, is generally similar to Maki et al and comprises a minor amount of a graft copolymer and a major amount of a polyethylene wax, or the like. We have found that upon heating a gap-transferred image from a developer having a toner comprising a major amount of polyethylene wax, or the like, there is "strike-through"; that is, the fluidity of the individual dots of toner in spreading becomes so great that the image becomes visible, or partially visible, on the back side of the paper. Such images cannot be used in a photocopying machine which duplexes—that is, one which prints on both sides of a paper sheet.

Tsubuko et al U.S. Pat. No. 4,104,183, granted Aug. 1, 1978, discloses a developing composition comprising a resin insoluble in an insulating liquid, such as ISOPAR-G (trademark of Exxon Corporation), and a polymer consisting of a monomer which can dissolve the resin. The developing composition of the instant invention contains only resins which are substantially insoluble in the insulating dispersant liquid at room temperature and solvatable in the insulating liquid at elevated temperatures.

SUMMARY OF THE INVENTION

In general, our invention contemplates the provision of a developing liquid comprising binders, or resins, for a pigment, which binders are substantially insoluble in the dispersant liquid component of our composition at ambient or room temperatures. The liquid component may be an aliphatic or isomerized hydrocarbon, such as ISOPAR-G (trademark of Exxon Corporation), or the like. This is an insulating liquid throughout which the pigmented binders are dispersed. The binders are such that, while they are substantially insoluble in the carrier liquid during the development phase which occurs at ambient temperature, they are rapidly solvatable at temperatures below 100° C. in the residual solvent carried across the gap to the carrier sheet. Our method includes the step of raising the transferred image, which is in gravure form, to a temperature of up to 100° C. This enables the dispersant carried over with the polymer to solvate the binder and spread the transferred image to form a dense image area corresponding to the original being reproduced. If the gap is formed by projections on the carrier sheet as shown in copending application Ser. No. 149,539, above referred to, or by spacers sprayed on the image after development while on the photoconductor or by spacers formed on the photoconductor per se as shown in our copending application Ser. No. 249,336, above referred to, no spacing particles need be added to the developing composition as shown in copending application Ser. Nos. 250,720, 267,465, and 298,351, above referred to.

OBJECTS OF THE INVENTION

One object of our invention is to provide a method of increasing the density upon a carrier sheet of a liquid-developed electrostatic image, which image has been transferred to the carrier sheet across a gap.

Another object of our invention is to provide a developing composition capable of carrying out the method of our invention.

Other and further objects of our invention will appear from the following description.

BRIEF DESCRIPTION OF THE DRAWINGS

In the accompanying drawings, which form part of the instant specification and which are to be read in conjunction therewith.

DESCRIPTION OF THE PREFERRED EMBODIMENT

Figure 1:
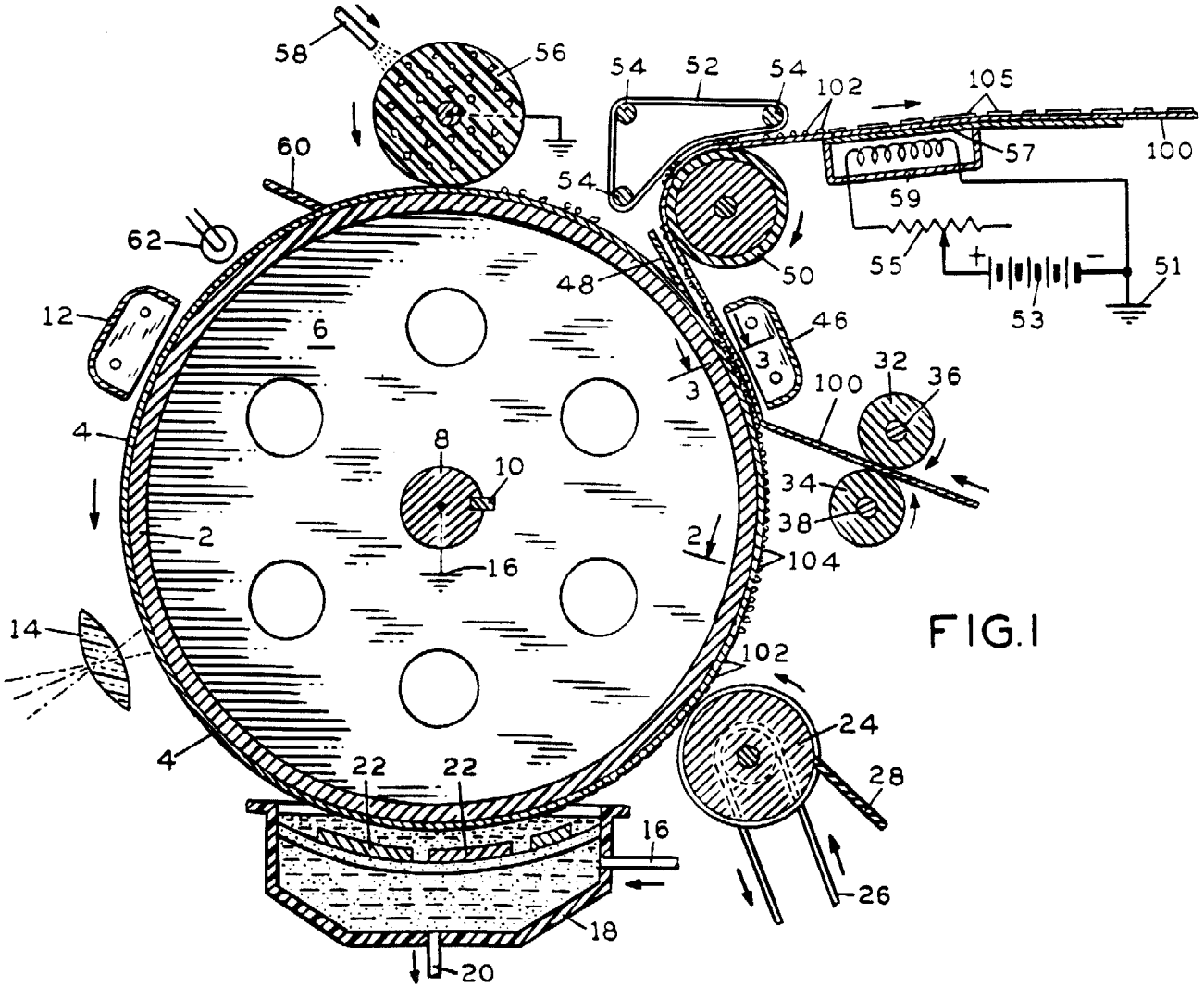
FIG. 1 shows one form of apparatus for carrying out our invention.

More particularly, referring now to the drawings, a metal drum 2 carries a photoconductor 4 and is mounted by disks 6 on a shaft 8 to which the disks are secured by a key 10 so that the assembly will rotate with the shaft 8. This shaft is driven in any appropriate manner (not shown) in the direction of the arrow past a corona discharge device 12 adapted to charge the surface of the photoconductor 4, it being understood that the assembly is in a lightproof housing (not shown). The image to be reproduced is focused by a lens 14 upon the charged photoconductor. Since the shaft 8 is grounded at 16' and the disks 6 are conductive, the areas struck by light will conduct the charge, or a portion thereof, to ground, thus forming a latent electrostatic image. A developing liquid, comprising an insulating carrier liquid and toner particles, is circulated from any suitable source (not shown) through pipe 16 into a development tray 18 from which it is drawn through pipe 20 for recirculation. Development electrodes 22, which may be appropriately biased as known to the art, assist in toning the latent electrostatic image as it passes in contact with the developing liquid. Charged toner particles, disseminated through the carrier liquid, pass by electrophoresis to the latent electrostatic image, it being understood that the charge of the particles is opposite in polarity to the charge on the photoconductor 4. If the photoconductor is selenium, the corona charge will be positive and the toner particles will be negatively charged. If the photoconductor is made of cadmium sulphide, the charge will be negative and the toner particles will carry a positive charge. The amount of liquid on the surface of the photoconductor is normally too great. Accordingly, a roller 24, whose surface moves in a direction opposite to the direction of movement of the surface of the photoconductor, is spaced from the surface of the photoconductor and is adapted to shear excess liquid from the developed image without disturbing the image. This roller is shown in Hayashi et al U.S. Pat. No. 3,907,423. It is driven by any appropriate means, such as by drive belt 26, and kept clean by a wiper blade 28. The drive belt 26 is driven by any appropriate speed-controllable means (not shown since such is known to the art). The reverse roller may be biased as shown in copending application Ser. No. 267,465, filed May 27, 1981.

A pair of register rolls 32 and 34 are adapted to feed the carrier sheet 100, which is to receive the developed image, toward the photoconductor. The register rolls 32 and 34 are mounted on axles 36 and 38 to which the register rolls are secured for rotation therewith. The axles are driven in synchronism so that there is no relative motion between the points of closest approach of the rolls 32 and 34 to each other. If desired, only one of the register rolls need be driven. The register rolls are adapted to feed the carrier sheet 100, which is to receive the developed image, to the transfer station. The corona discharge device 46 is adapted to impress a charge upon the rear of the carrier sheet 100 of a polarity opposite to the polarity of the toner particles forming the developed image so as to draw the developed image toward the carrier sheet across the gap. A pick-off member 48 ensures the removal of the carrier sheet bearing the developed image from the photoconductor, in the event any portion thereof should stick to the photoconductor. A roller 50, coacting with a plurality of flexible bands 52, delivers the carrier sheet to an exit tray (not shown). The flexible bands are mounted on a plurality of rollers 54. The transferred image leaving the roller 50 is in the form of discrete dots 102 which are formed by toner particles having a small amount of carrier liquid associated therewith. In order to effect the object of our invention—that is, to cause solvation of the toner particles in the entrained carrier liquid—it is required that we heat the image up to a temperature at which the polymer comprising the toner solvates in the entrained carrier liquid which temperature is 100° C. or less. We do this by heating the back of the carrier sheet 100. A housing 59 having a closed end 57 forms a support for the paper bearing the image. A heating coil within the housing 59 is adapted to be energized by a battery 53. The temperature of the heating coil is controlled by a variable resistor 55 through which the temperature applied to the rear of the paper is such that the image itself is heated to effect the solvation of the toner polymer in the entrained carrier liquid. A cleaning roller 56, formed of any appropriate synthetic resin, is driven in a direction opposite to the direction of the photoconductor to scrub the surface of the photoconductor clean. To assist in this action, developing liquid may be fed through pipe 58 to the surface of the cleaning roller 56. A wiper blade 60 completes the cleaning of the photoconductive surface. Any residual charge left on the photoconductive drum is extinguished by flooding the photoconductor with light from lamp 62.

The carrier sheets, almost universally used, comprise paper. If a carrier sheet is left in contact with the image before transfer, there will be absorption of the liquid component from the image and a very poor transfer will result owing to the dryness of the image. Furthermore, without the gap, the non-image areas will also be covered with dispersing liquid, which is usually a low-boiling aliphatic hydrocarbon such as ISOPAR-G and the like. These hydrocarbons are good insulators and have a resistivity of $10^{10}$ ohm-centimeters or greater. While these hydrocarbons are non-toxic, it is undesirable, from the point of cost and possible objection, to have too much evaporation into the circumambient atmosphere.

The charge carried by the toner particles, necessary to form an image on the photoconductor, may be low, since the development time is longer than the transfer time. In our gap transfer, however, the particles forming the developed image must retain a charge sufficiently high to effect transfer across the gap. The corona voltage necessary to effect transfer is limited by the insulating qualities of the photoconductor in the dark—that is, its dark resistance. Since our method contemplates transfer across a gap, the image must be wet. If the image is too dry, no transfer will take place across the gap. The reverse roller 24 can be adjusted to give a wetter image. This, however, increases the amount of the dispersant carried out, which is not desirable. In a developed image on the photoconductor, we find stratification; that is, the toner particles are close to the photoconductor and the dispersant is on the top. In our invention, this stratification is not particularly disadvantageous, since there is no contact between the paper to which the image is to be transferred and the developed image itself. The degree of wetness of the image can be controlled by adjusting the gap between the surface of the photoconductor 4 and the surface of the reverse roller 24.

Figure 2:
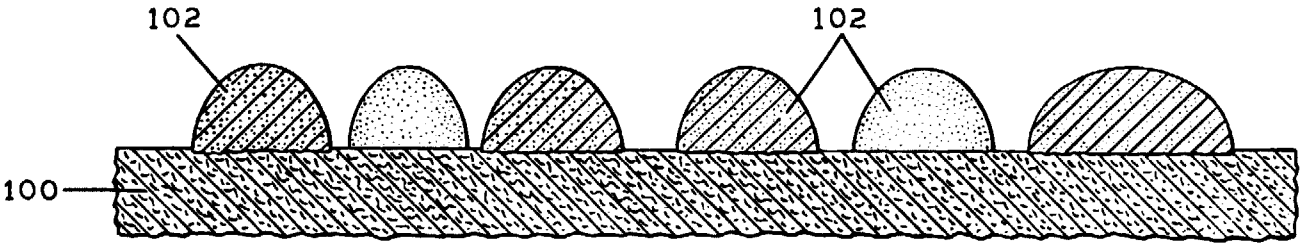
FIG. 2 is a sectional view, drawn on an enlarged scale, showing a portion of a transferred image before salvation of the toner particles.
Figure 3:
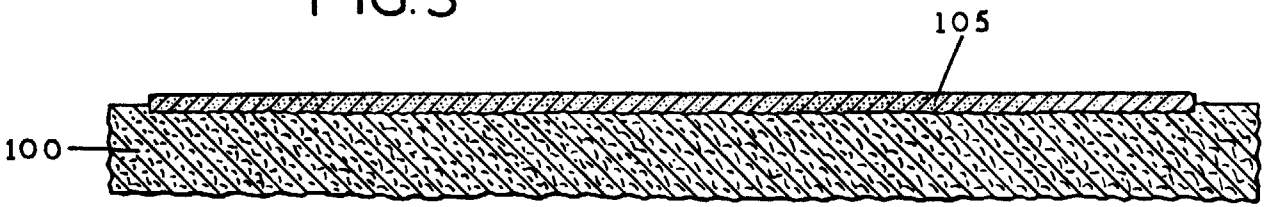
FIG. 3 is a view, similar to FIG. 2, showing a portion of the transferred image after its density has been increased.

In general, we employ binders for the pigment which develops the image which are capable of solvation. The solvatable binder particles forming the toner will become swollen or gelatinous in the dispersant at temperatures below 100° C. or dissolve therein. When the image negotiates the gap in the form of small dots, as shown in FIG. 2 of the drawings, heating the image by the heater 59 enables the binder to solvate in the dispersant present in the transferred image. Because the transferred dots are spaced, no strike-through will take place. Isolated areas of the image will become dense to form continuous areas of image 105, as shown in FIG. 3. The density will be a function of the gray scale of the original being copied.

It will be observed that there is scraping blade 28 contacting the surface of the reverse roller 24. In practice, a high-pitched sound is produced by the scraping blade. The binders which we use in our formulation act as lubricants—a result which is serendipitous. There are a number of natural waxes and synthetic waxes which are useful in the developing composition of our invention. We shall designate each by name, approximate melting point, and iodine value. As is known in the art, iodine value is the number expressing the percentage by weight of iodine absorbed by a substance. This is the measure of the preparation being tested of unsaturated linkages present in the substance. Free fatty acids are usually associated with natural waxes. An acid value is the number which indicates the amount of free acids present, expressed in the number of milligrams of potassium hydroxide required to neutralize free fatty acids in one gram of the substance. A small amount of free fatty acid is beneficial, in that it has a high degree of lubricity and prevents the screeching noise between the wiper blade and the reverse roller.

In order to impart a correct polarity to the toner particles, we add a minor amount of a charge director to the composition. The polarity of this charge director depends on the type of photoconductor used. If the photoconductor were selenium or selenium-tellurium, it would be charged with a positive corona and the toner particles would bear a negative charge. If the photoconductor were cadmium sulphide, or the like, the corona would be negative and the toner particles and the spacer particles, if used, would be positively charged. If the photoconductor were amorphous silicon, it could be doped either positive or negative—as is the case, of course, with poly-N-vinyl carbazole and its derivatives, which can be doped either positive or negative as desired.

Suitable negative charge directors are linseed oil, calcium petroleum sulphonate (manufactured by WITCO Corporation of Canada), and alkyl succinimide (manufactured by Chevron Chemical Company of California). Positive charge directors are sodium dioctyl sulfosuccinate (manufactured by American Cyanimid Company), zirconium octoate, and metal soaps such as copper oleate.

The toner particles, as is known to the art, usually comprise a pigment, such as carbon black, associated with a polymer. The amount of carbon black which we use may vary between 10 percent and less than 50 percent by weight of the amount of binder or polymer used. The polymers which are used are such that they will not dissolve at room temperature in the liquid component of the developing liquid. The polymers, however, in our invention, must be such that they will solvate at a higher temperature than room temperature. We have discovered that there is sufficient residual carrier liquid associated with the transferred image so that, when the transferred image on the carrier sheet is raised to above the critical solvation temperature, the image—which is normally composed of a series of dots separated by various lateral distances depending on the density of the original—suddenly and unexpectedly, remarkably very rapidly, becomes denser. We have found that paper may be heated to a temperature in the vicinity of 230° C. for a period of over an hour without charring or igniting the paper. However, raising it to higher than 100° C. requires considerably more energy owing to the latent heat of the water content of the paper. All of the polymers or binders which we use in our developing composition will solvate in the dispersant liquid at temperatures of 100° C. or less.

The dispersant or insulating liquid which we employ may be ISOPAR-G or ISOPAR-H (trademarks of Exxon Corporation). These are branched chain paraffinic hydrocarbon liquids (largely decane), though other insulating liquids may be used. The toner comprises a binder and a pigment. The quantity of toner which we employ may vary from between 0.1 percent to 10 percent by weight in respect of the dispersant liquid. This contrasts with the usual range of toner concentration of approximately 0.1 percent to 2 percent by weight of toner in respect of the dispersant liquid. If the development is slow, the lower level of concentration of toner can be used, but the upper limit of 2 percent cannot ordinarily be exceeded, in conventional liquid development, without producing discoloration of the background areas. In our gap-transfer process, we are enabled to employ as high as 10 percent by weight of toner particles in respect of the dispersant liquid, since our image is transferred across an air gap, and there will be no discoloration of the background areas. This enables a copying machine using the developing composition of our invention to be operated at a much higher speed while producing a denser image having high contrast.

While ISOPAR-G is commonly used as a dispersant in electrophotographic copying machines using liquid developers, other isoparaffinic hydrocarbons may be used. ISOPAR-G is a narrow cut of hydrocarbon liquid (largely decane) having a boiling point between 319° F. and an end or dry point of 345° F. We may employ a higher boiling hydrocarbon, such as ISOPAR-M (also a trademark of Exxon Corporation), which has a boiling range between 410° F. and 485° F. and has a lower boiling pressure.

EXAMPLE I

Into a high shear ball mill were placed 100 cc of ISOPAR-M, 5 grams of carnauba wax, 1 gram of carbon black, and 100 milligrams of sodium dioctyl sulfosuccinate. The mixture was agitated while 300 cc of ISOPAR-G were slowly added until the mixture became homogeneous. This concentrate was dispersed in 2,000 grams of ISOPAR-G to form a developing composition. The carnauba wax contains free fatty acid, which acts as a lubricant and prevents the high-pitched scraping sound made by the reverse-roller wiper blade mentioned above. If spacing particles are desired, we add to this mixture 4 grams of glass microspheres having an average diameter of 20 microns.

EXAMPLE II

The same procedure as in EXAMPLE I was followed, except that 4 grams of refined montan wax with 2 grams of carbon black were used and the charge director was 100 milligrams of lecithin.

EXAMPLE III

The same procedure as in EXAMPLE I was followed, except that 7 grams of candelilla wax were used and 7 grams of carbon black were employed. The charge director was a neutral calcium petronate, sometimes known as "mahogany soap". The increase in the amount of carbon black in respect of the wax tends to interfere with film formation. Since there is not sufficient binder for the carbon black, the image produced will tend to be dusty.

EXAMPLE IV

The same procedure as in EXAMPLE I was followed, except that 100 grams of microcrystalline wax and 100 grams of rice bran wax, together with 20 grams of carbon black, were used. The microcrystalline wax does not contain any free fatty acids or esters of fatty acids and tends to make the wiper blade of the reverse roller squeal. The rice bran wax contains free fatty acid, which acts as a lubricant.

EXAMPLE V

The same procedure as in EXAMPLE I was followed, except that 1.66 grams of hydrogenated castor oil were used as a binder and 0.33 gram of carbon black was used.

Other waxes which can be used are bamboo leaf wax, beeswax, carandá wax, Douglas-fir bark wax, palm wax, and peat wax. The advantage of Douglas-fir bark wax is that it is inexpensive, though its melting point varies considerably. All the aforementioned waxes solvate in ISOPAR-G. The amount of glass microspheres may vary from 0.1 gram to 10 grams or more. Synthetic waxes, such as polyethylene homopolymer 617A, manufactured by Allied Chemical Corporation, of Morristown, N.J., may be used as the binder. So, also, oxidized homopolymer 656, manufactured by Allied Chemical Corporation, of Morristown, N.J., may be used as a binder.

The characteristics of the binder are as follows:

1. It must be substantially insoluble in the carrier liquid (ISOPAR) at ambient or room temperature.

2. It must solvate in the dispersant liquid (ISOPAR) at temperature of 100° C. or lower.

3. It must be capable of retaining a residual charge sufficiently great to respond to a potential behind the carrier sheet so that it may negotiate the gap between the surface of the photoconductor and the carrier sheet.

The following table shows some examples of binder waxes capable of use in our invention.

Natural and Synthetic Binder Waxes

| Wax | Approximate Melting Point (°C.) | Approximate Iodine Value | Approximate Acid Value |
|---|---|---|---|
| Bamboo leaf | 80 | 8 | 14.5 |
| Carandá | 80-84 | 8-9 | 5-10 |
| Carnauba | 83-86 | 7-13 | 3-10 |
| Montan | 76-86 | 14-17 | 23-31 |
| Ouricury | 79-84 | 7-8 | 3-21 |
| Palm | 74-86 | 9-17 | 5-11 |
| Hydrogenated Castor Oil | 84-88 | 2-9 | 1-5 |
| Chinese insect | 81-84 | 1.4 | .2-1.5 |
| Indian corn | 81 | 4.2 | 1.9 |
| Shellac | 79-82 | 6-8 | 12-24 |
| Polyethylene Homopolymer 617A | 102 | 0 | 0 |
| Polyethylene Homopolymer 6A | 106 | 0 | 0 |
| Oxidized Homopolymer 655 | 107 | 0 | 16 |
| Douglas-fir bark | 59-73 | 26-62 | 59-80 |
| Microcrystalline (white) | 71-89 | 0 | 0 |
| Rice bran | 75-80 | 11 | 16 |

When the heating coil shown in FIG. 1 is raised to above the critical temperature at which solvation takes place, the transferred image, which was grayish owing to the spacing between the dots of toner, becomes dramatically and suddenly dense and blacker. The rapidity with which this result is accomplished and the clarity and density of the image are remarkably surprising. While we have shown the heating means after the transfer station, it is to be understood that the heating means may be positioned below the transfer station so the surface of the paper will become sufficiently hot to enable the image, upon transfer, to dissolve in the entrained dispersant.

It will be seen that we have provided a novel method of increasing the density of liquid-developed, gaptransferred electrophotographic images and a novel developing composition for use therein. Our method and composition enable us to copy originals by an electrophotographic process using a liquid developer in which the copy may be transferred to a paper having a great variety of surface textures, from very smooth to quite rough. A dense and clear image having good contrast is formed.

It will be readily seen that the total solids content present in the finished developing composition is in the amount of between approximately 10 percent and 0.1 percent by weight in respect of the weight of the dispersant liquid. Similarly, it will be seen that the amount of carbon black varies from approximately 10 percent by weight of the weight of the waxy binder to approximately 50 percent by weight of the weight of the waxy binder. While we have described carbon black as the pigment, since it is most commonly available and employable, any suitable pigment which may be finely divided and is insoluble in the dispersant can be used as the agent to color all or part of the waxy binder. We have found that it is not necessary to color all of the binder. The charge director which we employ will, of course, as is understood by those skilled in the art, impart a polarity to the binder particles which is opposite to the polarity of the charge of the latent electrostatic image. This will depend on the composition of the photoconductor being employed, as is known to the art. The amount of charge director can be easily determined empirically, by trial and error, for the particular charge director used. Charge directors are known in the prior art.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a method of electrophotography in which a latent electrostatic image is formed on a photoconductive surface, the latent image is developed on said surface with toner particles comprising a polymer dispersed in a carrier liquid, said polymer being substantially insoluble in said carrier liquid at ambient temperatures and solvatable in said carrier liquid at an elevated temperature, and in which the developed image is transferred across a gap to a sheet positioned a predetermined distance from the photoconductive surface, the improvement which comprises heating said gap-transferred image to an elevated temperature sufficient to solvate a substantial portion of said polymer in said carrier liquid associated with said transferred image whereby rapidly to increase the density of the transferred image.

2. A composition adapted to develop latent electrostatic images on a photoconductor for transfer to a carrier sheet forming a gap with said photoconductor including in combination a low-boiling hydrocarbon dispersant liquid and a solids content of between 2 grams and 220 grams per 1000 grams of dispersant liquid, said solids content comprising a pigment and a binder, the ratio by weight of said pigment in respect of said binder being between 10 percent and 50 percent, said binder being substantially insoluble in the dispersant liquid at ambient or room temperature and being solvatable in the dispersant liquid at elevated temperatures of under 100° C.

3. A composition as in claim 2 containing in addition from 0.1 gram to 10 grams of spacing particles insoluble in said dispersant liquid per kilogram of dispersant liquid.

4. A composition as in claim 2 containing a minor amount of a charge director.

5. A composition as in claim 2 containing a minor amount of a charge director and in addition from 0.1 gram to 100 grams of spacing particles insoluble in said dispersant liquid for each kilogram of dispersant liquid.

* * * * *